United States Patent [19]

Ehrnström

[11] Patent Number: 4,711,678

[45] Date of Patent: Dec. 8, 1987

[54] PROCESS FOR THE PREPARATION OF A WATER-IN-OIL EMULSION EXPLOSIVE AND A FUEL PHASE FOR USE IN SUCH PROCESS

[75] Inventor: Hans Ehrnström, Gyttorp, Sweden

[73] Assignee: Nitro Nobel AB, Gyttorp, Sweden

[21] Appl. No.: 857,138

[22] Filed: Apr. 29, 1986

[30] Foreign Application Priority Data

May 8, 1985 [SE] Sweden ..... 8502282

[51] Int. Cl.[4] ..... C06B 45/00

[52] U.S. Cl. ..... 149/2; 149/21; 149/88; 149/109.6

[58] Field of Search ..... 149/2, 21, 109.6, 88

[56] References Cited

U.S. PATENT DOCUMENTS

| | | | |
|---|---|---|---|
| 3,886,010 | 5/1975 | Thornley et al. | 149/60 |
| 4,490,194 | 12/1984 | Cooper et al. | 149/2 |
| 4,490,195 | 12/1984 | Cooper et al. | 149/2 |
| 4,500,369 | 2/1985 | Tag et al. | 149/2 |
| 4,594,118 | 6/1986 | Curtin et al. | 149/21 |

*Primary Examiner*—Stephen J. Lechert, Jr.
*Attorney, Agent, or Firm*—Burns, Doane, Swecker & Mathis

[57] ABSTRACT

Fuel phase for use as a continuous phase together with a discontinuous aqueous oxidizing salt phase in water-in-oil emulsion explosives, comprising a carbonaceous fuel and at least one but not all components of a gassing system; process for the preparation of a water-in-oil emulsion explosive by emulsifying an aqueous oxidizing salt phase into a carbonaceous fuel phase and introducing into the emulsion voids by using a gassing system, characterized in that at least one but not all components of said gassing system is distributed in at least part of the fuel phase and that the salt phase is then emulsified into the fuel phase containing salt component; and a water-in-oil emulsion explosive system in two-pack form, wherein one pack comprises an aqueous oxidizing salt phase containing at least one but not all components of a gassing system and the other pack comprises a carbonaceous fuel phase containing the remaining components of said gassing system.

20 Claims, No Drawings

PROCESS FOR THE PREPARATION OF A WATER-IN-OIL EMULSION EXPLOSIVE AND A FUEL PHASE FOR USE IN SUCH PROCESS

The present invention relates to water-in-oil emulsion in explosive systems for use in blasting operations and the invention covers a process for the preparation of such emulsion explosive by emulsifying an aqueous oxidizing salt phase into a carbonaceous fuel phase and introducing into the emulsion voids by using a gassing system. The invention also covers a fuel phase for use as a continuous phase in such emulsion explosive.

Emulsion type explosives have been known for some time, see for example U.S. Pat. No. 3,447,978 disclosing the general composition of such explosives. The basic ingredients of emulsion explosives are an aqueous salt solution component forming a discontinuous emulsion phase and a carbonaceous fuel component forming a continuous emulsion phase. As a sensitizer, such explosives may contain occluded gas for imparting sensitivity to the explosive.

Several suggestions have been made for in situ formation of occluded gas in the emulsion by the use of gassing agents, see for example U.S. Pat. Nos. 3,706,607; 3,711,345; 3,713,919; 3,770,522; 3,790,415 and 4,008,108. Common problems with these known methods are difficulties with dosage and even distribution and timing of gas generation in relation to the mixing operation.

A general problem of using explosives lies in the handling of the explosive in connection with storage, transportation to the blasting site etc. Quite generally, extensive precautions have to be taken in order to avoid undesired detonation before the explosive has been transferred to the blasting site and for example into boreholes provided in the ground. Governmental regulations are quite strict in regard to the handling and transportation of explosives.

The invention has for its main object to eliminate or at least significantly reduce the hazards involved in the handling and transportation of emulsion type explosives.

Another object of the invention is to provide for a water-in-oil emulsion explosive system for use in blasting operations, the system including safety measures largely eliminating the hazards involved in conventional systems hitherto used.

Yet another object of the invention is to provide a process whereby even distribution of the gassing system components in the emulsion is assured to result in evenly distributed voids or bubbles of occluded gas.

The present invention is based on an entirely new concept of providing a water-in-oil emulsion explosive system, which system is basically supplied in a two-part form, wherein one part comprises an aqueous oxidizing salt phase containing at least one but not all components of a gassing system and the other part comprises a carbonaceous fuel phase containing the remaining components of said gassing system.

The term "gassing system" as used herein refers to a system comprising at least two components, and not until all components of the system have been brought together will gas be evolved to generate voids or bubbles of occluded gas in the emulsion explosive.

According to one aspect of the invention there is thus provided a process for the preparation of a water-in-oil emulsion explosive by emulsifying an aqueous oxidizing salt phase into a carbonaceous fuel phase and introducing into the emulsion voids by using a gassing system. Based on the general concept of the invention such process is characterized in that at least one but not all components of said gassing system is distributed in at least part and preferably the predominant or the whole fuel phase and that the salt phase is then emulsified into the fuel phase containing said component. When bringing the two phases together the gassing system will be completed and gas will be released from the system to form evenly distributed voids throughout the emulsion explosive.

Many gassing systems are conceivably used in connection with this invention and by the term "component" used in this context is meant either physical components like chemical substances in solid, liquid or gaseous form, or functional components, such as heating or the like. Thus, the activation of the gassing system can be provided by heating simultaneously with or after emulsification takes place. It is also possible to activate the gassing system by reaction between one component present in the fuel phase with another component present in the salt phase.

A particularly preferred gassing system is based on the components acid, nitrite and urea or thiourea, at least one of said components being present in the fuel phase and the remaining ones being present in the salt phase before emulsification takes place.

In another embodiment of the process of the invention activation of the gassing system can take place by heating and in such embodiment the fuel phase component can be activated in connection with or after emulsifying the fuel phase with a salt phase of a higher temperature. By using a moderately heated salt phase a sufficient temperature raise of the relatively smaller fuel phase can easily be obtained and heat transfer problems when treating a finished emulsion can be avoided.

According to another aspect of the invention there is provided a fuel phase for use as a continuous phase together with a discontinuous aqueous oxidizing salt phase in water-in-oil emulsion explosives, such fuel phase comprising a carbonaceous fuel and at least one but not all components of a gassing system. In such a fuel phase the said component could be a finely divided powder insoluble in the fuel phase. Improved control and bubble size distribution is obtained when said component is dissolved in the fuel phase or when said component is a liquid emulsified into the fuel phase. The latter alternative is preferred also i.a. because the concentration of the component in the liquid emulsified into the fuel phase can be used as an additional parameter for control and because it gives a more rapid gassing reaction.

According to one embodiment of the invention the said component present in the fuel phase may be part of a system which is of a type that releases gas upon heating. The said component can be selected from the group comprising dinitroso compounds, diisocyanates, carbonates bicarbonates and peroxides.

As indicated earlier in this disclosure said component can be of a type whereby gasses released by reaction with at least another component. Said component can also be part of a system, which is of the type that releases gas upon acidification.

A particularly preferred gassing agent or system is one based upon nitrite and urea, which upon acid activation liberates gas according to one or both of the following reactions:

$$CO(NH_2)_2+2HNO_2 \rightarrow CO_2+2N_2+3H_2O \quad (I)$$

$$2CO(NH_2)_2+2HNO_2 \rightarrow 2N_2+2HCNO+4H_2O \quad (II)$$

Generally it is preferred to generate gases of low solubility in the emulsion explosive, such as hydrogen, oxygen and particularly nitrogen. A shift towards the preferred second reaction can be obtained by a high urea/nitrite ratio, e.g. above about 1:1 and preferably above about 3:1. Suitably the acid is added to the salt phase the nitrite to the fuel phase. Urea can be added to either phase but preferably to the fuel phase since it is not stable in the salt phase for long periods at elevated temperature.

According to yet another aspect of the invention there is provided a water-in-oil emulsion explosive system in two-pack form. In such system one pack comprises an aqueous oxidizing salt phase containing at least one but not all components of a gassing system, whereas the other pack comprises a carbonaceous fuel phase containing the remaining components of said gassing system. When acid is used to activate the gassing system it is preferred that the pH of the aqueous salt phase is well below neutral, suitably below about 5 and especially below about 4. Lowering of the pH of the aqueous phase is conventional in the art can be provided by using for example a weak organic acid, such as tartaric acid or maleic acid. Strong acids may, of course, also be used.

It should be noted that the invention is not limited to the specific gassing systems mentioned herein and that any gassing system is useful based on at least two components. From a practical point of view at least one component must be constituted by a physical substance whether in solid, liquid or gaseous form, whereas the other component or components can be either physical ones or functional ones or both. Obviously, many gassing agents may be used, such as those mentioned previously and specifically ammonium bicarbonate and sodium bicarbonate and also sodium azide. Two-component systems include carbonates and acid, peroxides and catalysts, hydrazines and oxidizing agents etc. Suitable systems are disclosed in the above mentioned U.S. applications, the disclosures of which are incorporated herein by reference.

Since the two parts of the explosive system of the invention are in themselves non-explosive no sensitive products have to be handled and transported before the mixing operation takes place. Such mixing operation can take place at any time up to arrival on the site of using the explosive. It is particularly preferred to mix the two parts of the explosive system on site whereby no transportation of the readymade explosive need to take place.

The exact composition of the emulsion explosive system of this invention is not critical and conventional components can be used. Thus, as an aqueous salt phase or solution forming a discontinuous emulsion phase there may be used ammonium nitrite, sodium nitrite, or any other conventional oxidizing salt or mixtures thereof.

The carbonaceous fuel component forming a continuous emulsion phase is fully conventional in the art usually includes an oil or wax component, a wax and an oil component, a wax and a polymeric material component or a wax and a polymeric modified oil component. For details regarding the ingredients we refer to U.S. Pat. No. 3,447,978, the disclosure of which is incorporated herein by reference.

The explosive system of the invention may also in a conventional manner contain one or several emulsifying agents and also auxiliary fuels, such as alluminum powder. The emulsifying agent is preferably contained in the fuel phase.

An emulsion of the invention could e.g. comprise about 3 to 10 percent by weight of a fuel including a emulsifier, about 8 to 25 percent by weight of water, about 50 to 86 percent by weight of inorganic oxidizing salts and about 0 to 20 percent by weight of an additional fuel, such as aluminum.

The quantity gassing agent used is also conventional in the art, and such quantities are generally used as will result in a density of the emulsion explosive lying within the range about 0.9 to about 1.3 kg per $dm^3$ or sufficient for the required sensitivity. In general gas bubbles in the size range 10 to 150 $\mu m$ are preferred.

The new emulsion explosive system according to the invention designed as a two-part system has several advantages over the conventional art. Thus, the technique of activating the gassing system by mixing the two parts of the system results in an even distribution of occluded gas in the emulsion. Moreover, admixing the gassing agent which constitutes a relatively small amount is facilitated by the fact that part thereof is first introduced into the fuel phase which is then mixed with the aqueous phase whereby a better distribution of the gassing agent is obtained. Furthermore, the two-pack system enables safer transportation since neither of the two parts is an explosive per se.

From a practical point of view of explosive system of the invention facilitates cleaning of tanks and equipment which results in a minimum of losses of ingredients. The investment costs for building a plant will be reduced in view of simplification of the equipment used. Furthermore, from a transportation point of view, the fuel phase which constitutes only a minor part of the combined system can be supplied as a ready-made mixture, whereas the oxidizing salt phase which can be easily made from conventional ingredients can be supplied at or close to the site of use of the emulsion.

If the salt and the fuel phase are mixed above the gas occlusion temperature the composition may later be thickened by cooling or curing of a cross-linkable fuel component to retain the gas in the composition. Preferably the composition is also given its final shape before thickening, e.g. filled into cartridges, into film or directly into a borehole. Although the gassing method of the invention is useful in all these situations it is of particular value for bulk manufacture at the blasting site, especially when charged for final gassing and thickening directly in the borehole when the viscosity also can be adapted to prevent subsequent flow into cracks etc.

The invention will now be further illustrated by specific examples which, however, must not be construed to limit the scope of the invention as claimed. In the following examples the parts and percentages given refer to weight if not otherwise indicated.

EXAMPLE 1

An explosive system in accordance with the invention is prepared using the following constituents:

Oxidizing salt phase

An aqueous solution prepared using ammonium nitrate (617.5 g), sodium nitrate (167.5 g), water (155 g)

and tartaric acid (1.0 g), the resulting solution having a pH of about 3.8.

Fuel phase

This fuel phase consists of wax (50 g) and, as an emulsifyer, Span®80 (10 g) (sorbitan monooleate sold by Atlas Chemie AG, West Germany). As gassing components there are used sodium nitrite (1.07 g) and urea (4.67 g) dissolved in water (8.67 g). All ingredients of the fuel phase are thoroughly mixed at about 65° C., whereby the water solutions form droplets of about 2–5 μm in the wax.

The salt phase prepared as outlined above is then emulsified into the fuel phase at about 60° C. using a conventional household mixer to form an emulsion having a density in the cold of 1.05. The resulting emulsion contains occluded gas evenly distributed therein formed upon mixing of the two phases due to the acidic pH of the salt phase. The congealing point of the final composition is about 50° C.

EXAMPLE 2

Example 1 is repeated but using 0.8 g of sodium nitrite and 3.5 g of urea together with an unchanged amount of water in the gassing system. The resulting emulsion has a density in the cold of 1.10.

EXAMPLE 3

Example 1 is repeated while using 0.61 g of sodium nitrite and 2.68 g of urea and other constituents being the same. The density of the resulting emulsion in the cold is 1.19.

EXAMPLE 4

Example 1 is again repeated but this time using 0.46 g of sodium nitrite and 2.03 g of urea. The emulsion obtained has a density in the cold of 1.27.

EXAMPLE 5

Example 1 is repeated except that the following gassing system is used: sodium nitrite (1.07 g), urea (4.67 g), water (8.67 g) and alluminum powder (50.0 g). The procedure of example 1 is followed resulting in an emulsion having a density in the cold of 1.05.

EXAMPLE 6

The procedure of example 5 is repeated but using 0.75 g of sodium nitrite and 3.2 g of urea. The emulsion obtained in this example has a density in the cold of 1.13.

EXAMPLE 7

The procedure of example 1 is repeated but using the following constituents:

Oxidizing salt phase

Ammonium nitrate (752 g), water (188 g) and tartaric acid (1.0 g).

Fuel phase

Wax (50 g) and Span®80 (10 g), the gassing components consisting of sodium nitrite (0.46 g), urea (2.03 g) and water (8.67 g). The procedure of example 1 is followed and an emulsion is obtained which has a density in the cold of 1.20 and a congealing point of about 50° C.

It can be added that in all the above examples the aqueous phase is formed by dissolving the constituents thereof in water at a temperature of about 60° C.

The explosive emulsions prepared in the above examples 1 to 7 after cooling to environment temperature are tested in 4 inch PVC-tubes and initiated with 0,5 kg high velocity primer (Startex A, trademark Nitro Nobel, Sweden). The velocities of detonation in meters per second are given in the table below. The three columns of velocities given in said table refer to a storage period for the respective emulsions of 2 weeks, 8 weeks and 12 weeks, respectively.

| | Velocity after: | | |
|---|---|---|---|
| Ex. No. | 2 weeks | 8 weeks | 12 weeks |
| 1 | 5170 | 5150 | 5090 |
| 2 | 5220 | 5050 | 5120 |
| 3 | 5400 | 5230 | 5280 |
| 4 | 5560 | 5270 | 5210 |
| 5 | 5290 | 5300 | 5180 |
| 6 | 5460 | 5390 | 5410 |
| 7 | 5280 | 5280 | 5110 |

In the following specific examples there are used alternative gassing systems. All figures in the examples refer to percent by weight.

EXAMPLE 8

| | |
|---|---|
| Fuel phase | |
| Oil | 5.14 |
| Sorbitolmonooleate | 1.00 |
| Solid Na $BH_4$ (dispersed in the fuel phase) | 0.07 |
| Oxidizing salt phase | |
| Ammonium nitrate | 61.70 |
| Sodium nitrate | 16.50 |
| Water | 15.59 |

When the hot (60° C.) oxidiser solution was emulsified into the fuel phase rapid gassing took place, giving a density of 1050 kg/m$^3$.

EXAMPLE 9

| | |
|---|---|
| Fuel phase | |
| Oil | 4.72 |
| Sorbitolmonooleate | 0.94 |
| 10% water solution of $NH_4HCO_3$ | 1.00 |
| Oxidizing salt phase | |
| Ammonium nitrate | 70.87 |
| Water | 17.72 |
| Additional fuel dispersed in the fuel phase. | |
| Pulverulent Al | 4.75 |

When the hot (62° C.) oxidiser solution was emulsified into the oil a fast reaction took place, resulting in a density of 1100 kg/m$^3$.

EXAMPLE 10

| | |
|---|---|
| Fuel phase | |
| Wax | 4.84 |
| Sorbitolmonooleate | 0.76 |
| $NaHCO_3$ (10% solution in water | 1.5 |

-continued

| | |
|---|---|
| emulsified in the wax) | |
| Oxidizing salt phase | |
| Ammonium nitrate | 58.20 |
| Sodium nitrate | 15.50 |
| Water | 14.55 |
| Tartaric acid | 0.10 |
| Additional fuel dispersed in the fuel phase. | |
| Pulverulent Al | 4.55 |

When the oxidiser was emulsified into the fuel phase gassing took place resulting in a density of 980 kg/m$^3$.

I claim:

1. Fuel phase for use as a continuous phase together with a discontinuous aqueous oxidizing salt phase in water-in-oil emulsion explosives, comprising a carbonacous fuel and distributed therein a fuel phase component comprising at least one but not all components of a gassing system, the fuel and fuel phase component being adapted to product gas or bubbles throughout the emulsion when combined with an aqueous oxidizing phase containing remaining components of the gassing system.

2. Fuel phase according to claim 1, wherein said fuel phase component is insoluble in the fuel phase.

3. Fuel phase according to claim 2, wherein said fuel phase component is present in a liquid phase emulsified in the fuel phase.

4. Fuel phase according to claim 1, wherein said fuel phase component is part of a system which is of the type that releases gas upon heating.

5. Fuel phase according to claim 4, wherein said fuel phase component is selected from dinitroso compounds, diisocyanates, carbonates, bicarbonates and peroxides.

6. Fuel phase according to claim 1, wherein said fuel phase component is of a type whereby gas is released by reaction with at least another component.

7. Fuel phase according to claim 1, wherein said fuel phase component is part of a system which is of the type that releases gas upon acidification.

8. Fuel phase according to claim 7, wherein said gassing agent or system comprises nitrite and urea or thiourea.

9. Fuel phase according to claim 8, wherein the mole ratio of urea to nitrite is above about 1:1.

10. A process for the preparation of a water-in-oil emulsion explosive comprising the steps of (i) emulsifying an aqueous oxidizing salt phase containing at least one but not all components of a gassing system into a carbonaceous fuel phase containing remaining components of the gassing system and (ii) introducing voids into the emulsion by using the gassing system.

11. A process according to claim 10 wherein said fuel phase component is distributed in the predominant part of the fuel phase before emulsification.

12. A process according to claim 10 wherein said fuel phase component is activated by heating in connection with or after the emulsification.

13. A process according to claim 10 wherein said fuel phase component is activated by a component present in the salt phase.

14. A process according to claim 13 wherein the gassing system comprises the components acid, nitrite and urea or thiourea, at least one of said components being present in the fuel phase and the remaining ones being present in the salt phase before the emulsification.

15. A process according to claim 12 characterized in that activation by heating takes place by emulsifying the fuel phase with a salt phase of a higher temperature.

16. A water-in-oil emulsion explosive system in two pack form, wherein one pack comprises an aqueous oxidizing salt phase containing a least one but not all components of a gassing system and the other pack comprises a carbonaceous fuel phase containing the remaining components of said gassing system, a gas being evolved to form voids in said emulsion after said first and second packs have been combined.

17. A process according to claim 11, characterized in that said component is activated by heating in connection with or after the emulsification.

18. A process according to claim 11, characterized in that said component is activated by a component present in the salt phase.

19. A process according to claim 18, characterized in that the gassing system comprises the components acid, nitrite and urea or thiourea, at least one of said components being present in the fuel phase and the remaining ones being present in the salt phase before the emulsification.

20. A process according to claim 17, characterized in that activation by heating takes place by emulsifying the fuel phase with a salt phase of a higher temperature.

* * * * *